US005832552A

United States Patent [19]

Haselwander

[11] Patent Number: 5,832,552

[45] Date of Patent: Nov. 10, 1998

[54] STEAM FIXATION COMB

[75] Inventor: Jack G. Haselwander, Chattanooga, Tenn.

[73] Assignee: Belmont Textile Machinery Company, Mt. Holly, N.C.

[21] Appl. No.: 774,204

[22] Filed: Dec. 27, 1996

[51] Int. Cl.[6] ..... D06B 1/08; D06B 5/06

[52] U.S. Cl. ..... 8/149.3; 8/151.2; 68/5 D; 68/6

[58] Field of Search ..... 8/149.3, 151.2; 68/5 D, 5 E, 6, 212; 19/66 T; 28/282, 283

[56] References Cited

U.S. PATENT DOCUMENTS

| | | | |
|---|---|---|---|
| 2,080,193 | 5/1937 | Bakker | 68/200 X |
| 2,228,260 | 1/1941 | Dreyfus et al. | 68/5 E |
| 2,228,272 | 1/1941 | Kinsella | 68/5 E |
| 3,865,565 | 2/1975 | Spence et al. | 28/282 X |
| 4,457,034 | 7/1984 | Simmen | 68/200 X |

*Primary Examiner*—Philip R. Coe
*Attorney, Agent, or Firm*—Alan Ruderman

[57] ABSTRACT

One or more dye fixation combs are mounted within a high temperature dye fixation steamer housing downstream from the yarn dyeing device and a post steamer and upstream of a coiler which places the yarn in coil form onto a conveyor for subsequent operations in a dye line. The yarn is fed in warp form through the high temperature steamer. Each comb has a series of spaced apart fingers extending from the body of the comb. The body of the comb is hollow and defines a conduit. Between each pair of fingers at the location of the comb body is a root having an orifice communicating with the conduit. A strand of yarn is directed through each root guided by a pair of support rods, one of which is upstream of the comb and the other of which is downstream of the comb. The yarn is under tension and is directed against the outlet of the orifice. A source of superheated steam is supplied to the conduit so that each yarn strand as it moves in warp form through the steamer is impinged upon by steam above 212° F.

11 Claims, 5 Drawing Sheets

STEAM FIXATION COMB

BACKGROUND OF THE INVENTION

This invention relates generally to dyeing of yarns and more particularly to a steam fixing device for accelerating fixation of the dye while the yarns are in warp form to thereby improve the clarity of the dye pattern and substantially reduce the smearing of dye during the subsequent coiling of the yarn. In the art of dyeing yarn, after the yarn is dyed it is transported through one or more atmospheric steamers in warp form. The yarn is then coiled onto a conveyor belt and transported through a final steamer. After exiting the steamer, it is washed, vacuumed to remove the unfixed dye and dried. After exiting the dryer, the yarn is removed from the conveyor belt and wound onto separate yarn packages.

The purpose of the steamers is to substantially fix the dyes in the yarn before the yarn enters the coiling device. If the dyes are not fixed before the yarn enters the coiling device, clarity of the colors and smearing of one color onto the other may occur. Since there are openings for the yarn to enter and exit the steamers, they operate under atmospheric pressure and the maximum temperature attained is approximately 210° F. The first atmospheric steamer after the dye station through which the yarn is fed in warp form is generally known as a post-steamer. Typically such steamers are in the order of three to twelve feet long. Because the yarn in warp form typically moves at approximately 2000 feet per minute, the length of time the yarn is in such atmospheric steamers is about 0.36 seconds. After the yarn has been coiled onto a conveyor belt the yarn enters the final atmospheric steamer for a dwell time of one to three minutes. For nylon type yarns, this is usually sufficient, but other yarns require additional dwell time in the final steamer.

It is known that fixation of the dye on the yarn at temperatures above the 212° F. boiling point under atmospheric pressures will accelerate the fixation. However, as aforesaid, the yarn is traveling in warp form rather than being in bulk form such as knitted into a sock, the steamers are open and thus superheating of the steam has not be practicable in such steamers.

SUMMARY OF THE INVENTION

Consequently, it is a primary object of the present invention to provide a method and apparatus for accelerating the fixation of dye in a yarn dyeing process on yarns traveling in warp form through a steamer by providing steam at temperatures above the 212° F. maximum temperature of steam at normal atmospheric pressure.

It is another object of the present invention to provide in a steamer housing in a yarn dye line for aiding in fixation of the dye on the yarn entering and leaving the steamer in warp form, apparatus for permitting superheated steam to be applied to the yarn.

It is a further object of the present invention to provide a steam fixation comb for applying superheated steam to a plurality of yarn strands while the yarn is passing in warp form through a steamer open to atmospheric pressure.

Accordingly, the present invention provides one or more yarn dye fixation combs within a yarn dye fixation steamer housing, each comb having a plurality of fingers between each pair of which is a root having an orifice which communicates with a steam supply conduit and through which steam under pressure and at a temperature above the boiling temperature of water at atmospheric pressure is fed.

That is, the steam is superheated steam. A strand of yarn is directed through each root of the comb while being fed from the entrance of the steamer to the exit thereof. The yarn strands which are under tension are guided into and out of the roots of the comb by means of support rods so each yarn is moved firmly through the respective root and the pressurized high temperature steam exiting the respective orifice is forced through the yarn. Thus, with the yarn traveling at a typical speed of 2,000 feet per minute, even though the time within the steamer is very short, e.g. 0.18 seconds for a steamer which is six foot in length, the dye fixation is substantial with improved dye pattern coloration clarity even though in warp form so that when the yarn is subsequently coiled, smearing of the dye is reduced substantially.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
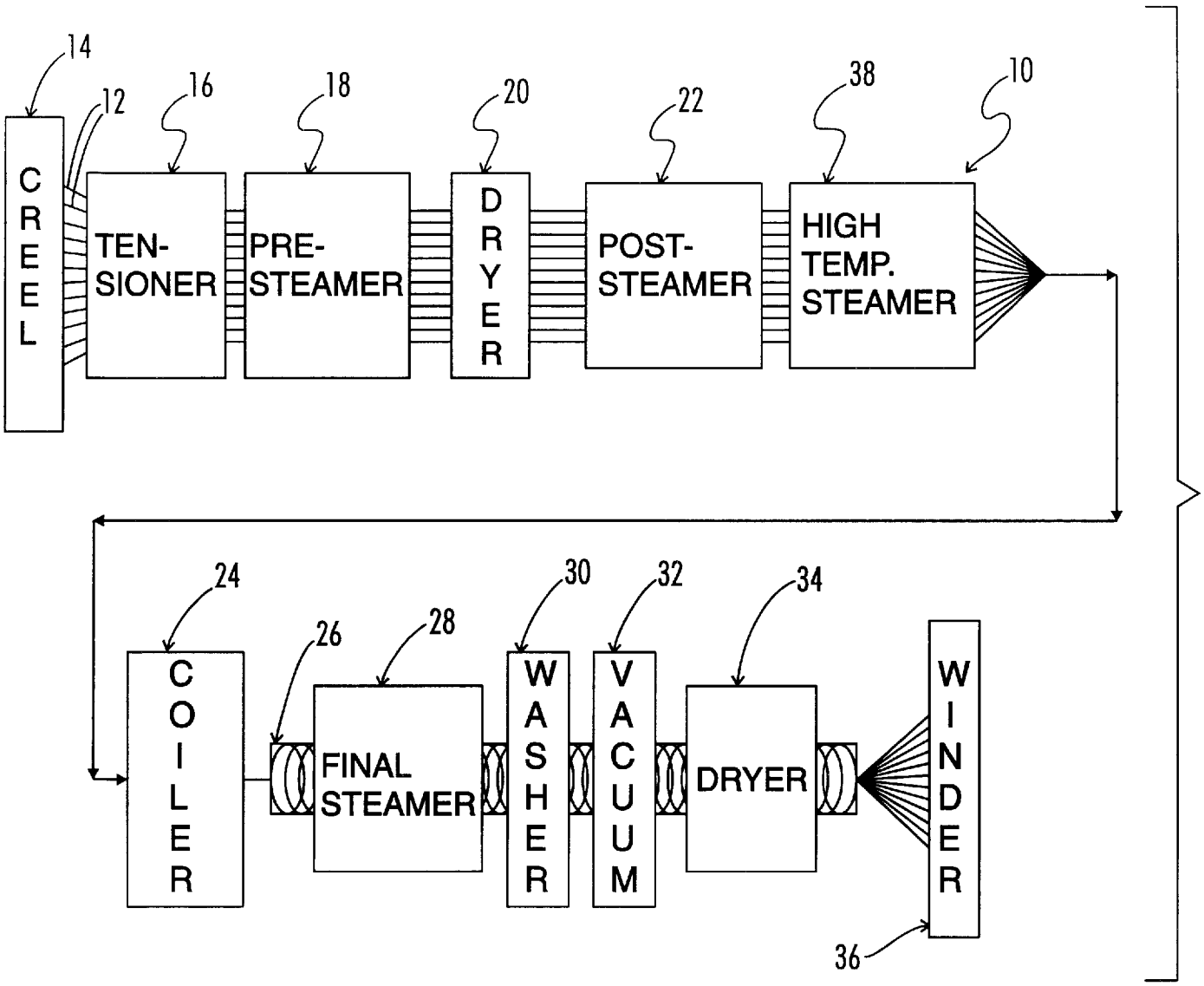
FIG. 1 is a diagrammatic block diagram illustrating a typical dyeing process but including a high temperature steamer having at least one steam fixation comb constructed in accordance with the present invention.

Referring now to the drawings, FIG. 1 illustrates a block diagram of a typical yarn dyeing process, but includes a high temperature yarn fixation steamer 10 incorporating structure comprising the present invention. Briefly, the process involves drawing strands of undyed yarn 12 from a creel 14 or the like and feeding the yarn to a tensioning device 16 which places tension on the yarn by pulling the yarn strands while in warp form, that is, in the form wherein the yarn is traveling in a substantially straight or elongated path in an unraveled and uncoiled state. The yarn thereafter passes in warp form through a pre-dyeing steamer 18, i.e., a steamer which adds moisture to the yarn prior to the yarn being dyed. The yarn then enters the dyeing apparatus 20 which may be a printer wherein dye color is sprayed, rolled, stamped, etc. onto the strands of yarn in accordance with a pattern or the yarn may be vat dyed. The dyeing apparatus may be any convenient or desirable dyeing or printing device without departing from the spirit of the present invention. After the color has been applied to the yarn the yarn passes through a post-dyeing steamer 22 which comprises a housing in the form of a box having steam flowing from the bottom, through the yarn and up to the top. The yarn enters and exits through openings communicating with ambient atmospheric conditions at the front and rear of the post steamer housing and thus the steamer is an atmospheric steamer and the maximum temperature of the steam is 212° F. at normal elevations. Generally the steamer temperature is actually in the order of approximately 210° F.

The yarn, which is traveling very quickly in warp form, e.g. in the order of approximately 2,000 feet per minute, does not spend much time within the post steamer. For example, for a 12 foot post steamer the time within the steamer is approximately 0.36 seconds and therefore the dye may not be sufficiently fixed to prevent smearing of one color onto another when the yarn is subsequently coiled in rope form in a coiler 24. The coiler deposits the yarn in rope form onto a conveyor 26 which slows down the movement of the yarn so that when entering a final steamer 28 the yarn may dwell therein for one to three minutes. Such a dwell time is generally sufficient for nylon type yarns; other yarns may require additional dwell time within the final steamer to fix the dye. It may be noted that the tension placed on the yarn by the tensioning device 16 results from the tensioning device pulling the yarn from the coiler.

Completion of the dyeing process includes a wash system 30 which sprays water onto the yarn to wash off any excess dye or chemicals that may be on the yarn, a vacuum system 32 which may be a slot over which the yarn passes to remove the excess dye, chemicals and the water on the yarn, and a dryer 34 for removing the moisture from the yarn. The yarn exiting the dryer in coiled rope form on the conveyor 26 is thereafter separated into a warp configuration and is wound on a winder 36 having separate yarn take-ups for each strand of yarn.

Figure 2:
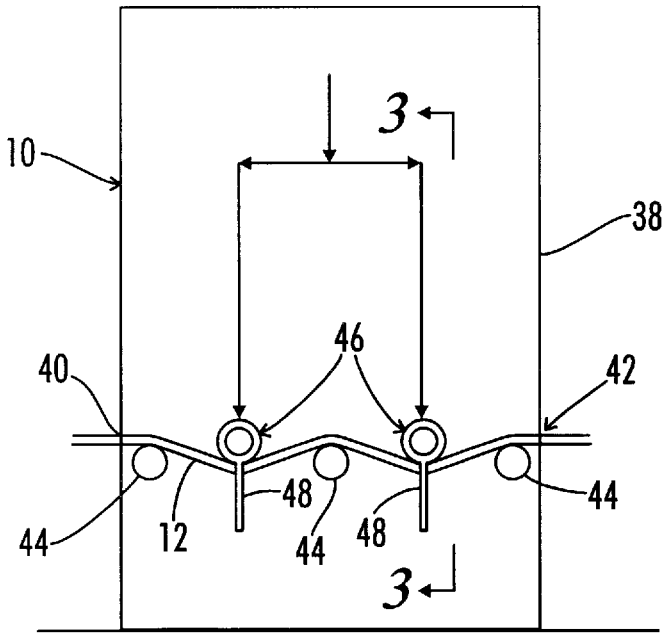
FIG. 2 is an enlarged sectional view partly in schematic form illustrating the high temperature steamer illustrated in FIG. 1.

The high temperature steamer 10 in the present invention may be similar to the post steamer 22 in that it comprises a housing 38 which may be in the form of a box having an entrance 40 and an exit 42 for the yarn strands 12. As illustrated in FIG. 2, in the interior of the steamer housing 38 are a plurality of yarn support rods 44 which support the yarn strands as they pass through a high pressure steam fixation comb 46 of the present invention, there preferably being such a comb between each pair of rods 44, i.e., one rod is upstream and the other rod is downstream of the comb.

Figure 4:
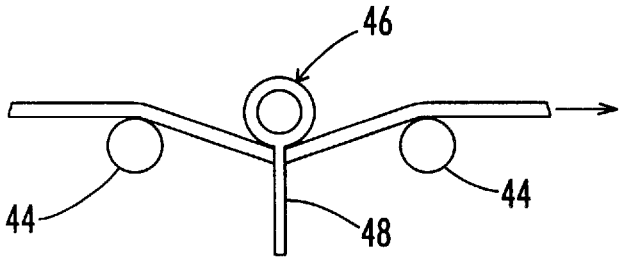
FIG. 4 is a cross sectional view taken substantially along line 4—4 of FIG. 3.
Figure 3:
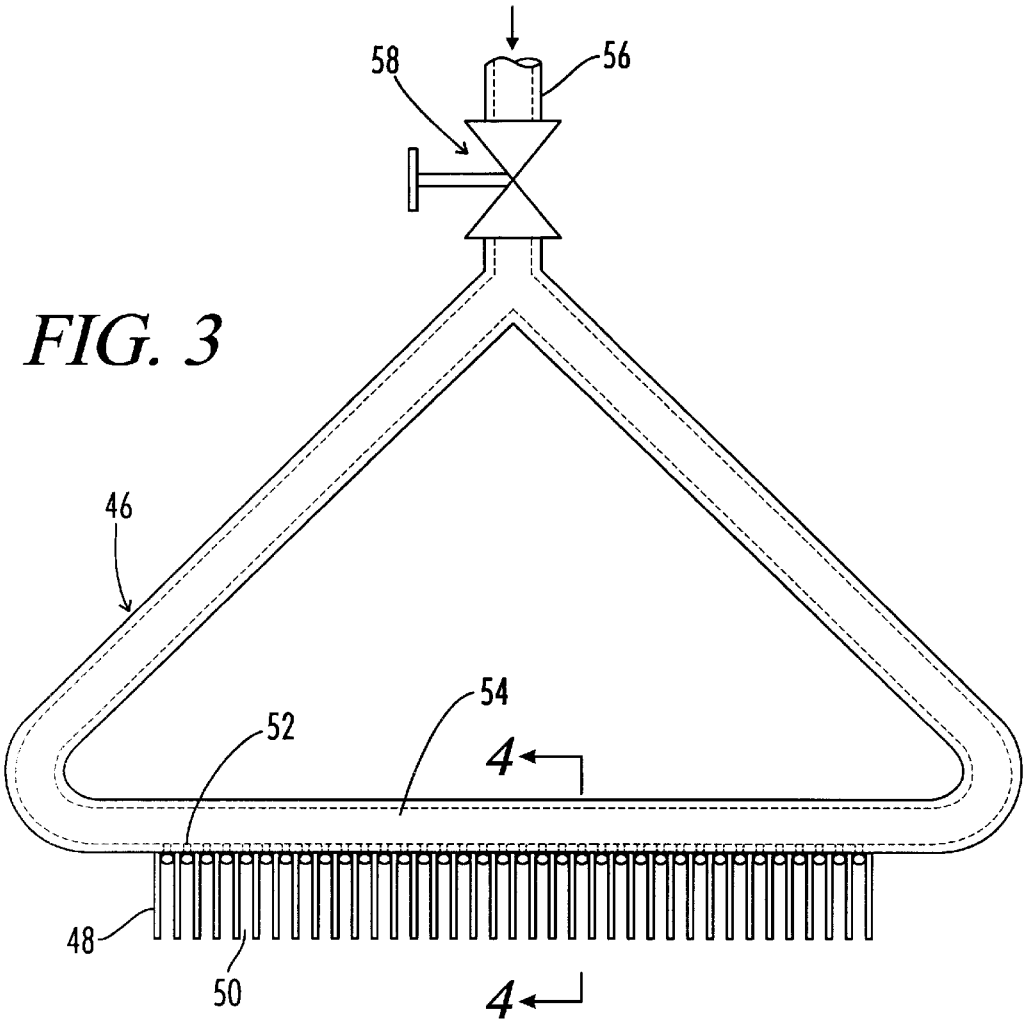
FIG. 3 is an enlarged cross sectional view of a steam fixation comb constructed in accordance with the principles of the present invention taken substantially along line 3—3 of FIG. 2.
Figure 5:
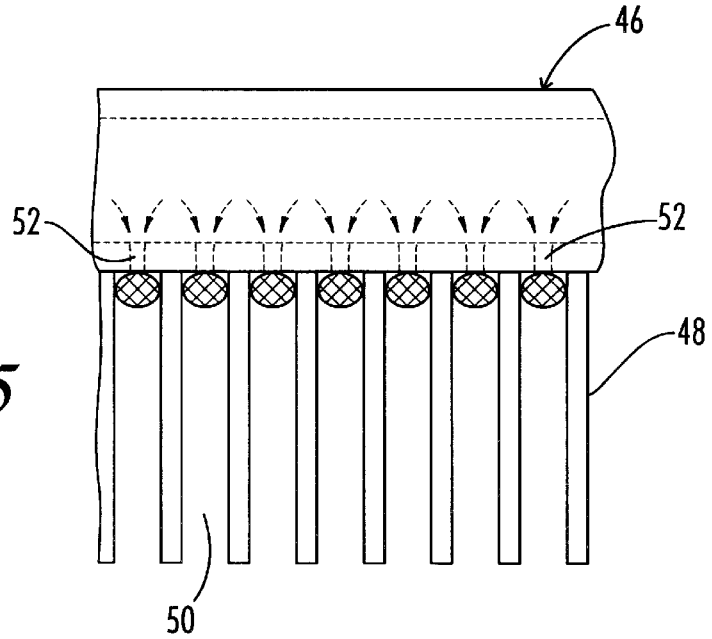
FIG. 5 is a fragmentary enlarged view of a portion of the comb illustrated in FIG. 3.

The steam fixation comb 46, as illustrated in FIGS. 3 and 5, comprises a multiplicity of fingers 48 extending from the body of the comb to define a multiplicity of yarn receiving grooves 50 between each pair of fingers and effectively defining and separating the fingers 48. At the root of each groove is an orifice 52 opening into the interior of the body of the comb 46 and the respective groove 50. Preferably, as illustrated, in FIGS. 2 and 4, the fingers extend downwardly from the body of the comb and the rods 44 are disposed beneath the yarn strands to support the yarns from beneath. Of course, the reverse, i.e., having the fingers extending upwardly and the rods being disposed above the yarn strands may be utilized because the yarn is under tension, without departing from the present invention.

Figure 6:
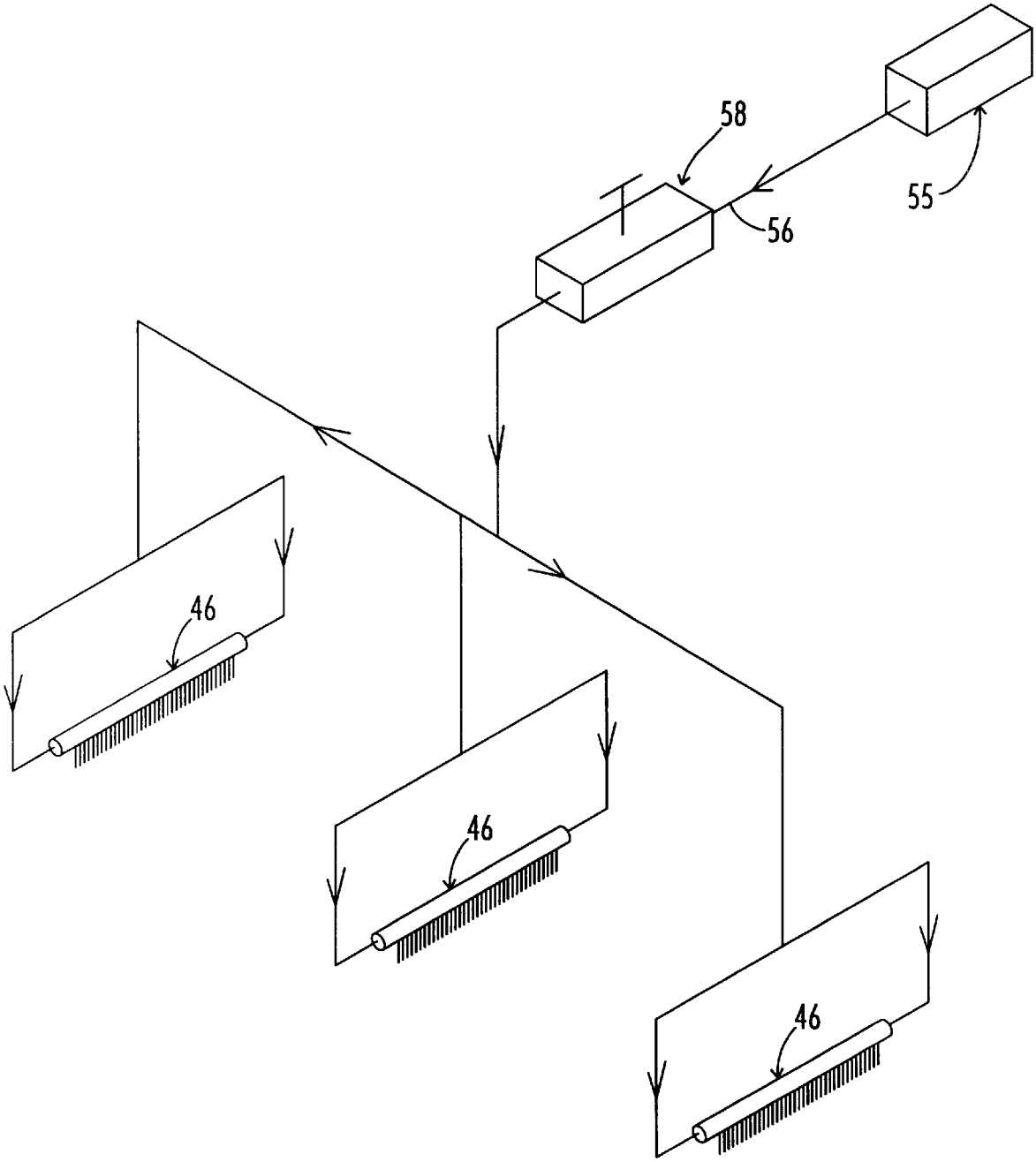
FIG. 6 is a schematic illustrating the flow of steam among a plurality of steam fixation combs according to the present invention.
Figure 7:
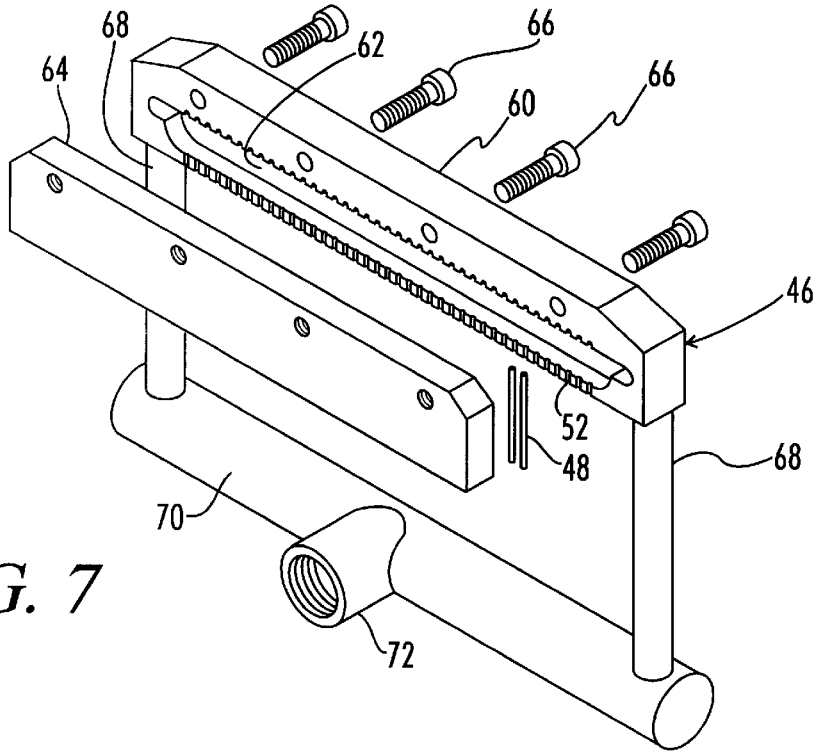
FIG. 7 is an exploded perspective view of the preferred form of a yarn fixation comb constructed in accordance with the present invention.
Figure 8:
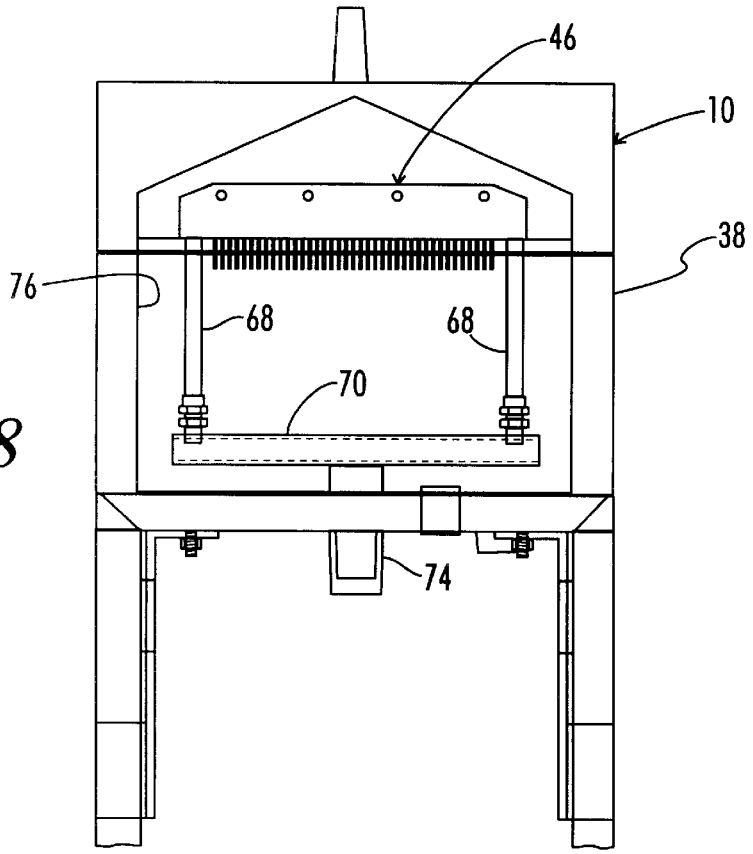
FIG. 8 is a vertical cross sectional view through a typical steamer with the comb of FIG. 7 mounted therein.

The body of the comb 46 from which the fingers extend comprises an elongated hollow member forming a conduit 54, the interior of the conduit communicating with the orifices 52. The remaining configuration of the comb is merely one which preferably provides steam at each end of the conduit 54, i.e., at each end of the array of fingers so that steam may flow equally from both ends of the conduit without substantial reduction in pressure and steam temperature across the entire array of orifices 52. Thus, the body of the comb may have a triangular configuration with the legs not having the fingers merely defining and forming piping as illustrated in FIG. 3, or may merely have separate piping or the like that conveys the steam to each end of the conduit 54 as illustrated in FIG. 6–8, and this may comprise any conventional means including 90° pipe elbows or various angular members. The point is that it is highly desirable to have the steam entering the finger carrying conduit 54 so that the steam orifices meter a substantially equal relatively precise amount of steam to each strand of yarn within the respective grooves 50. High pressure steam from a source such as a boiler 55 enters a steam line 56 and communicates with a steam regulator 58 which preferably is adjustable to regulate the steam pressure so that the pressure may be adjusted depending upon the yarn denier and the number of yarn strands.

The preferred embodiment of the comb 46 of the present invention is illustrated in FIGS. 7 and 8. Here the body of the comb 46 is formed from a first elongated block 60 of any desirable material such as stainless steel, and includes a channel 62 elongated in the direction of elongation of the block. Another elongated block 64 has a similar channel (not illustrated) and is aligned with the block 60 so that the channels are in register to define the conduit 54. At least the block 60 and preferably both blocks include openings defining the orifices 52 which open into the hollow of the conduit or manifold. The fingers 48 which preferably may be pins formed from stainless steel in the order of approximately 3/32 inch in diameter and 1.75 inches in length are clamped between the blocks 60, 64 alternating with the orifices when the blocks 60, 64 are clamped together by screws 66 or other clamping means.

The preferred manner of manufacturing the blocks comprises machining a block then splitting it into the two blocks 60, 64, machining the elongated channels 62 in the blocks, reclamping the blocks together and drilling holes through the clamping plane to form the openings defining the orifices 52. Thus, each orifice is composed of semi-circular openings in each block. The block 60 is thicker than the block 64 so that a steam line or pipe 68 may be connected thereto at both ends in flow communication with the channel 62. The lines 68 are connected in flow communication with a steam supply pipe 70 having a substantially centrally disposed connecting nipple 72 which is connected in communication with the outlet of the pressure regulator 58.

As illustrated in FIG. 8, the comb is mounted in the housing 38 of the steamer 10. Steam is fed under pressure through a fitting 74 at the bottom of the steamer housing and up into the pipe 70. The steam passes through the lines 68, into the channels 62 defining the conduit or manifold 54 and out through the orifices 52 between the fingers 48. Both the combs and the rods, which are not illustrated in FIG. 8 may readily be attached to the interior walls 76 of the steamer with conventional fasteners.

The yarn, which is supported by the rods 44, and is under tension, is guided into the root of each groove 50 by the vertical disposition of the rods. For example, by locating the center of the rods at the level of the root, i.e., the level of the orifices or above, the yarn strands are forced into the roots. Thus, the steam exiting the respective orifice 52 flows through the yarn. By ensuring that the steam is under a positive gauge pressure, i.e., a pressure above atmospheric pressure, steam at temperatures above 212° F. flows through the yarn strands resulting in accelerated dye fixation. This greatly enhances the fixation of the dye while the dye is still in warp form. Thus, the clarity of the dye patterns is greatly improved and the likelihood of smearing in the coiling device is greatly reduced.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A steam fixation comb for use in a steamer for accelerating fixation of dye on yarns passing through said steamer in warp form, said comb comprising an elongated hollow body member defining a conduit, a plurality of fingers extending from said body member in spaced apart relationship in the direction of elongation of said body member defining a root intermediate adjacent pairs of fingers, an aperture formed through said body member in each root defining an orifice for communicating the hollow of the body member with a respective root, and means for communicating said conduit with a source of superheated steam, whereby a strand of yarn directed into a corresponding root may be impinged upon with superheated steam.

2. A steam fixation comb as recited in claim 1, wherein said means for communicating said conduit with a source of superheated steam includes a pipe at respective ends of said body member in flow communication with said conduit, and means for communicating each pipe with a source of steam.

3. A steam fixation comb as recited in claim 1, wherein said body member comprises two blocks, each block having an elongated channel formed therein, and means for clamping said blocks together with said channels in registration to form said conduit.

4. A steam fixation comb as recited in claim 3, wherein said fingers comprise pins clamped between said blocks.

5. A steamer for aiding in the fixation of dye on yarns passing longitudinally therethrough in warp form, said steamer comprising a housing, at least one high temperature fixation comb mounted in said steamer, said comb comprising an elongated hollow body member extending transversely across said steamer and defining a conduit, a plurality of fingers extending from said body member in spaced apart relationship in the direction of elongation of said body member defining a root intermediate adjacent pairs of fingers, an aperture formed through said body member into each root defining an orifice for communicating the hollow of said body member with a respective root, a first yarn support member disposed upstream of said comb and a second yarn support member disposed downstream of said comb for guiding a strand of yarn into each root, and means for supplying superheated steam to said conduit for exhausting out said orifices and through a respective strand of yarn moving through a corresponding root.

6. A steamer as recited in claim 5, wherein said first and second yarn support members each comprise a rod extending transversely across said housing substantially parallel to the direction of elongation of said body member.

7. A steamer as recited in claim 6, wherein each rod is disposed for directing yarn into the respective root.

8. In the method of fixing dye on yarn strands subsequent to the strands being dyed, the improvement comprising:

feeding said yarn strands to a steamer having at least one yarn fixation comb mounted therein, said comb having a conduit therein and a plurality of spaced apart fingers with a root in the space between each pair of fingers and an orifice formed in each root communicating with said conduit, directing each yarn strand into a respective root, feeding superheated steam from a source to said conduit for feeding said steam through the orifices and onto said yarn strands, and feeding said yarn strands from said comb and out said steamer.

9. In the method as recited in claim 8, wherein said directing of each yarn comprises feeding the yarns over the surface of first and second support rods, the first of said rods being disposed upstream of said comb and the second of said rods being disposed downstream of said comb, the yarn engaging surface of each rod being disposed for directing said yarn strands into said roots.

10. In the method as recited in claim 9, including applying tension to said yarn strands.

11. In the method as recited in claim 8, wherein said steam is at a temperature above 212° F.

* * * * *